US012440016B1

(12) United States Patent
Lin et al.

(10) Patent No.: US 12,440,016 B1
(45) Date of Patent: Oct. 14, 2025

(54) HANGING POD

(71) Applicant: Ningbo Heimi Information Technology Co., Ltd., Ningbo (CN)

(72) Inventors: Yaping Lin, Yueqing (CN); Xiaomin Liu, Bozhou (CN)

(73) Assignee: Ningbo Heimi Information Technology Co., Ltd., Ningbo (CN)

( * ) Notice: Subject to any disclaimer, the term of this patent is extended or adjusted under 35 U.S.C. 154(b) by 0 days.

(21) Appl. No.: 19/169,022

(22) Filed: Apr. 3, 2025

(51) Int. Cl.

| | |
|---|---|
| ***A45F 3/26*** | (2006.01) |
| ***A47C 7/02*** | (2006.01) |
| ***A47C 7/72*** | (2006.01) |
| ***E04H 15/04*** | (2006.01) |
| ***E04H 15/10*** | (2006.01) |
| ***E04H 15/24*** | (2006.01) |

(52) U.S. Cl.
CPC ..... *A45F 3/26* (2013.01); *A47C 7/021* (2013.01); *A47C 7/725* (2013.01); *E04H 15/04* (2013.01); *E04H 15/10* (2013.01); *E04H 15/24* (2013.01)

(58) Field of Classification Search
CPC ..... E04H 15/04; E04H 15/10; E04H 15/24; A47C 7/725; A47C 3/26; A47C 7/021
USPC ..... 297/188.09, 188.12, 217.6, 273, 277; 135/90, 91, 100; 5/120, 122; 472/118, 472/135
See application file for complete search history.

(56) References Cited

U.S. PATENT DOCUMENTS

| | | | | | |
|---|---|---|---|---|---|
| 737,398 | A * | 8/1903 | Grote | A45F 3/26 | 297/277 |
| 950,839 | A * | 3/1910 | Chadwick | F24F 7/02 | 454/363 |
| 2,216,818 | A * | 10/1940 | Kuhlman | A47C 27/081 | 4/578.1 |
| 4,485,671 | A * | 12/1984 | Kershner | G01P 13/025 | 73/187 |
| 4,516,767 | A * | 5/1985 | Eskijian | A63B 5/11 | D6/601 |
| 4,860,395 | A * | 8/1989 | Smith | A47C 27/085 | 5/675 |
| 5,053,931 | A * | 10/1991 | Rushing | A45B 23/00 | 439/787 |
| 5,487,400 | A * | 1/1996 | Dawkins | E04H 15/324 | 135/124 |
| 5,911,493 | A * | 6/1999 | Walker | F21V 33/0004 | 135/910 |

(Continued)

*Primary Examiner* — Robert Canfield
(74) *Attorney, Agent, or Firm* — Bayramoglu Law Offices LLC

(57) ABSTRACT

The provided is a hanging pod, including a hanging pod body, a light-emitting device, and a soft cushion. The hanging pod body is hollow and conical, allowing a user to lie or sit inside the hanging pod body for rest or entertainment. A top of the hanging pod body is provided with a connector, through which the hanging pod is connected to an indoor hanging point or an outdoor tree trunk, railing, etc., such that the hanging pod is vertically hung as a whole. Featuring convenient setup and small footprint, the hanging pod can serve as a lightweight and easy-to-carry relaxation tool for the user during outdoor activities, and can be set up in a small space indoors for the user to rest or entertain. The light-emitting device is detachably connected to the hanging pod body. The light-emitting device can provide light indication and illumination in dark environments.

10 Claims, 9 Drawing Sheets

(56) References Cited

U.S. PATENT DOCUMENTS

D429,592 S * 8/2000 Dohan ..... D6/601
7,815,255 B1 * 10/2010 Kiel ..... B60N 2/38 297/216.1
D682,565 S * 5/2013 McDonald ..... D6/347
D760,506 S * 7/2016 McDonald ..... D6/347
D807,657 S * 1/2018 Zhang ..... D6/347
D820,608 S * 6/2018 Wehner ..... D6/347
D821,110 S * 6/2018 McDonald ..... D6/347
D902,610 S * 11/2020 Sun ..... D6/347
2002/0149928 A1 * 10/2002 Watterson ..... F21V 19/047 362/205
2003/0084931 A1 * 5/2003 Lee ..... A45B 3/04 135/910
2006/0207637 A1 * 9/2006 Coleiro ..... A45B 3/04 135/18
2006/0288943 A1 * 12/2006 Ku ..... A01K 1/0353 119/28.5
2008/0062675 A1 * 3/2008 Tung ..... F21V 21/10 362/102
2008/0072945 A1 * 3/2008 Grand Pre ..... E04H 15/10 135/96
2009/0007945 A1 * 1/2009 Ma ..... A45B 3/02 135/16
2010/0252083 A1 * 10/2010 Ogle ..... E04H 15/04 135/90
2011/0012394 A1 * 1/2011 Furman ..... B60N 2/2845 297/183.1
2015/0007863 A1 * 1/2015 Li ..... E04H 15/42 135/96
2015/0018108 A1 * 1/2015 Lacy ..... A63H 33/008 472/136
2016/0107095 A1 * 4/2016 Fries ..... A63H 33/008 472/136
2017/0234025 A1 * 8/2017 Bottome ..... E04H 15/04 135/90
2018/0236259 A1 * 8/2018 Nelson ..... A61N 5/0616
2019/0293278 A1 * 9/2019 McNae ..... A63F 13/285
2019/0338550 A1 * 11/2019 Zhu ..... F21V 33/006

* cited by examiner

HANGING POD

TECHNICAL FIELD

The present disclosure relates to the technical field of hammocks, and in particular to a hanging pod.

BACKGROUND

As a lightweight and easily storable relaxation tool, hammocks provide relaxation space for people during travel or leisure activities. To set up a hammock, it is necessary to spread the hammock and fix both ends of the hammock. Hammocks are categorized into fabric hammocks and rope net hammocks according to their materials. Fabric hammocks are typically sewn from a thin canvas or nylon fabric, while rope net hammocks are typically woven from cotton or nylon cords. Rope net hammocks are particularly suitable for tropical jungles and scorching summer, while fabric hammocks have a broader range of applications for all regions and seasons except extremely cold areas and winter.

The existing hammocks are spread horizontally and hung, with both ends fixed, resulting in high setup requirements and a large footprint. Therefore, they are not suitable for indoor hanging applications, and offer only fundamental functionality, making them restricted to singular usage scenarios.

SUMMARY

(I) Technical Problem to be Solved

In view of the above defects and shortcomings of the prior art, the present disclosure provides a hanging pod.

(II) Technical Solution

In order to achieve the above objective, the hanging pod of the present disclosure includes:

- a hanging pod body, where the hanging pod body is hollow and conical; and a top of the hanging pod body is provided with a connector;
- a light-emitting device, where the light-emitting device is detachably connected to the hanging pod body; and
- a soft cushion, where the soft cushion is provided at a bottom of the hanging pod body.

Preferably, a side of the hanging pod body is provided with a first opening that runs through inner and outer sides of the hanging pod body.

Preferably, the soft cushion is provided inside the hanging pod body and located at the bottom of the hanging pod body.

Preferably, the bottom of the hanging pod body is provided with a compartment; and the soft cushion is provided inside the compartment.

Preferably, the bottom of the hanging pod body is provided with a second opening; and the second opening is communicated with the compartment.

Preferably, the second opening is provided with a zipper.

Preferably, the soft cushion is a circular sealed structure filled with air inside.

Preferably, the light-emitting device includes a power supply, a controller, and a light strip; and the light strip and the power supply are connected to the controller through a wire;

- the hanging pod body is provided with a storage bag; and the controller and the power supply are provided inside the storage bag; and

- the hanging pod body is provided with a storage recess according to a set shape; and
- the light strip is provided in the storage recess.

Preferably, the storage recess is provided along a shape of the first opening.

Preferably, the light-emitting device includes a power supply, a controller, a light-emitting element, and multiple light-diffusing fibers; the light-emitting element and the power supply are connected to the controller through a wire; and one end of each of the multiple light-diffusing fibers is connected to the light-emitting element; and

- the hanging pod body is provided with a storage bag; the controller, the power supply, and the light-emitting element are provided in the storage bag; and the multiple light-diffusing fibers cover an outer surface of the hanging pod body.

Preferably, the outer surface of the hanging pod body is provided with a limiting member; and some of the light-diffusing fibers are detachably connected to the limiting member.

Preferably, the hanging pod further includes a lighting box; and the lighting box is provided between the soft cushion and the bottom of the hanging pod body.

Preferably, the soft cushion is a transparent circular sealed structure; a bottom of the soft cushion is provided with a mounting recess; and the lighting box is provided inside the mounting recess.

Preferably, the hanging pod body is a fabric product; and the connector is integrated with the hanging pod body.

Preferably, the hanging pod further includes an adjustable strap; and the adjustable strap is detachably connected to the connector.

Preferably, the hanging pod further includes a mounting bracket; and the mounting bracket is connected to the adjustable strap or the connector.

(III) Beneficial Effects

The hanging pod body is hollow and conical. The hanging pod allows a user to lie or sit inside the hanging pod body for rest or entertainment, offering both privacy protection and wind/sun protection functions. A top of the hanging pod body is provided with connector. The hanging pod is connected to an indoor hanging point or an outdoor tree trunk, railing, etc. through the connector, such that the hanging pod is vertically hung as a whole. Featuring convenient setup and small footprint, the hanging pod can serve as a lightweight and easy-to-carry relaxation tool for the user during outdoor activities, and can be set up in a small space indoors for the user to rest or entertain. The light-emitting device is detachably connected to the hanging pod body. As an accessory component of the hanging pod, the light-emitting device can provide light indication and illumination in dark environments, making it convenient for the user to use at night. Moreover, the light-emitting device enhances the aesthetics of the hanging pod body, increasing the fun of the hanging pod, and well meeting the indoor entertainment needs of children. The soft cushion is provided at a bottom of the hanging pod body, allowing the bottom of the hanging pod body to be spread open and maintain the hollow conical shape of the hanging pod body during use. Besides, the soft cushion also improves user comfort.

REFERENCE NUMERALS

1. hanging pod body; 10. connector; 11. first opening; 12. storage bag; 13. storage recess; and 14. limiting member;
2. light-emitting device; 20. control box; 21. light strip; and 22. light-diffusing fiber;
3. soft cushion; and 31. mounting recess;
4. lighting box;
5. adjustable strap; and
6. mounting bracket; and 7. safety hook.

DETAILED DESCRIPTION OF THE EMBODIMENTS

In order to better explain the present disclosure and facilitate understanding, the present disclosure is described in detail below with reference to the drawings and specific implementations. The terms such as "upper" and "lower" mentioned herein are based on the orientations shown in FIG. 1.

Although the drawings show the exemplary embodiments of the present disclosure, it should be understood that the present disclosure may be implemented in various forms and should not be limited to the embodiments set forth herein. On the contrary, these embodiments are provided such that the present disclosure is fully understandable, and fully conveys the scope of the present disclosure to those skilled in the art.

As shown in FIGS. 1 to 4, the present disclosure provides a hanging pod, including hanging pod body 1, light-emitting device 2, and soft cushion 3. The hanging pod body 1 is hollow and conical. The hanging pod allows a user to lie or sit inside the hanging pod body 1 for rest or entertainment, offering both privacy protection and wind/sun protection functions. A top of the hanging pod body 1 is provided with connector 10. The hanging pod is connected to an indoor hanging point or an outdoor tree trunk, railing, etc. through the connector 10, such that the hanging pod is vertically hung as a whole. Featuring convenient setup and small footprint, the hanging pod can serve as a lightweight and easy-to-carry relaxation tool for the user during outdoor activities, and can be set up in a small space indoors for the user to rest or entertain. The light-emitting device 2 is detachably connected to the hanging pod body 1. As an accessory component of the hanging pod, the light-emitting device can provide light indication and illumination in dark environments, making it convenient for the user to use at night. Moreover, the light-emitting device 2 enhances the aesthetics of the hanging pod body 1, increasing the fun of the hanging pod, and well meeting the indoor entertainment needs of children. The soft cushion 3 is provided at a bottom of the hanging pod body 1, allowing the bottom of the hanging pod body 1 to be spread open and maintain the hollow conical shape of the hanging pod body during use. Besides, the soft cushion 3 also improves user comfort.

Figure 1:
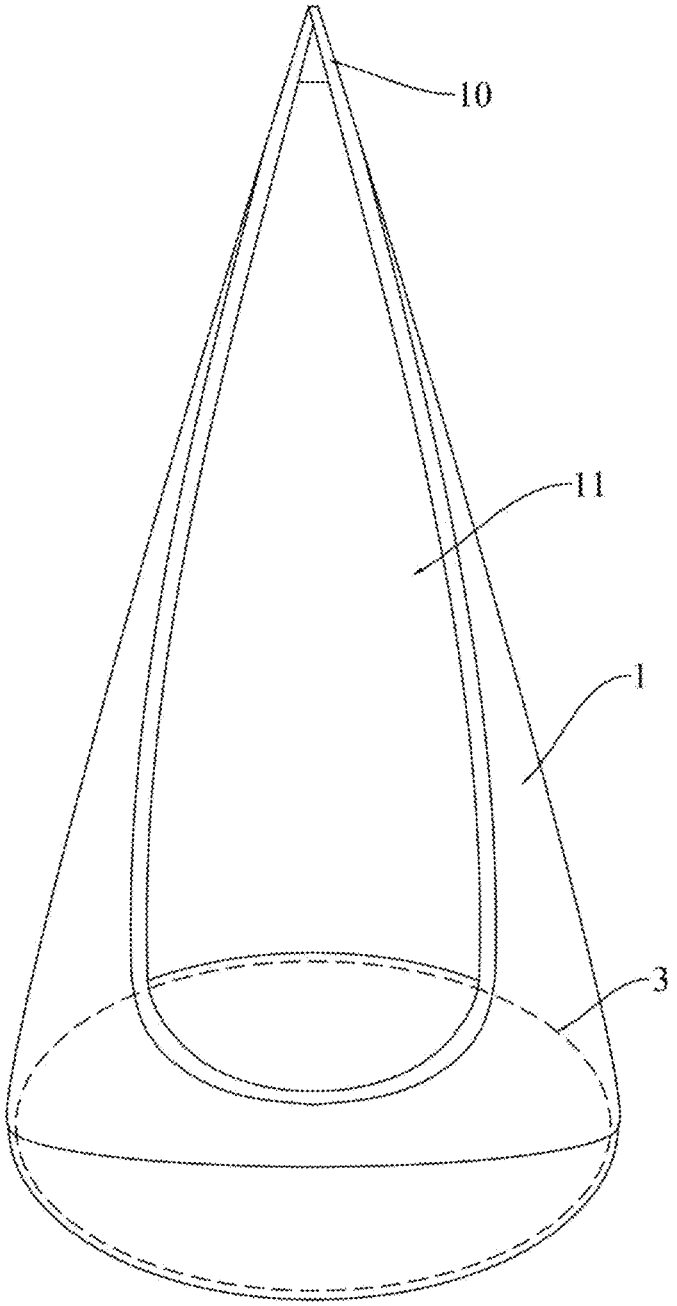
FIG. 1 is a structural schematic diagram of a hanging pod body according to the present disclosure.

Referring to FIG. 1, a side of the hanging pod body 1 is provided with first opening 11 that runs through inner and outer sides of the hanging pod body 1. The first opening 11 is provided for the user to enter and exit the hanging pod.

In an implementation, the soft cushion 3 is provided inside the hanging pod body 1 and located at the bottom of the hanging pod body 1. At least a top surface of the soft cushion 3 is made of a soft material. By using the soft cushion 3 to spread open the bottom of the hanging pod body 1, the hanging pod body is kept in a hollow conical state during use.

Furthermore, the bottom of the hanging pod body 1 is provided with a compartment, and the soft cushion 3 is provided inside the compartment. In this way, the user avoids direct contact with the soft cushion 3, so only the hanging pod body 1 needs to be cleaned.

Furthermore, the bottom of the hanging pod body 1 is provided with a second opening. Preferably, the second opening is located at a junction between the side and bottom surface of the hanging pod body 1. The second opening is communicated with the compartment. The second opening is located inside or outside the hanging pod body 1. The soft cushion 3 is put into the compartment through the second opening, making it easy to disassemble and assemble. Moreover, the second opening is provided with a zipper to prevent the soft cushion 3 from falling off from the second opening during use.

Figure 5:
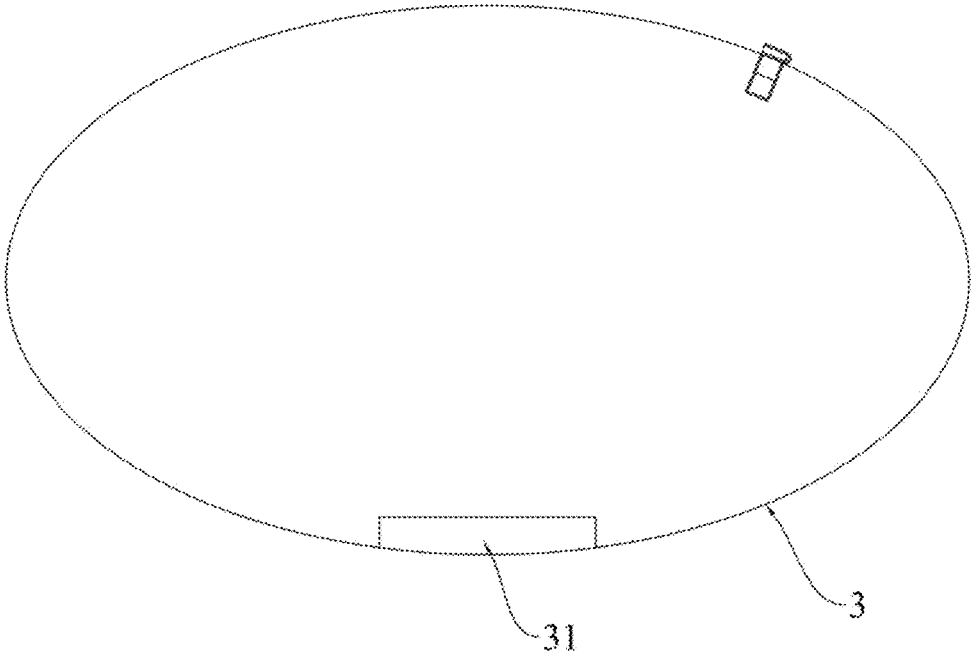
FIG. 5 is a structural schematic diagram of a soft cushion according to the present disclosure.

As shown in FIG. 5, the soft cushion 3 is a circular sealed structure. The sealed structure is provided with an air nozzle for inflating or deflating the sealed structure. When in use, the soft cushion 3 is filled with air inside to maintain its shape and elasticity. To bestow the soft cushion, the air inside the soft cushion is discharged for easy folding, storage, and carrying.

Figure 7:
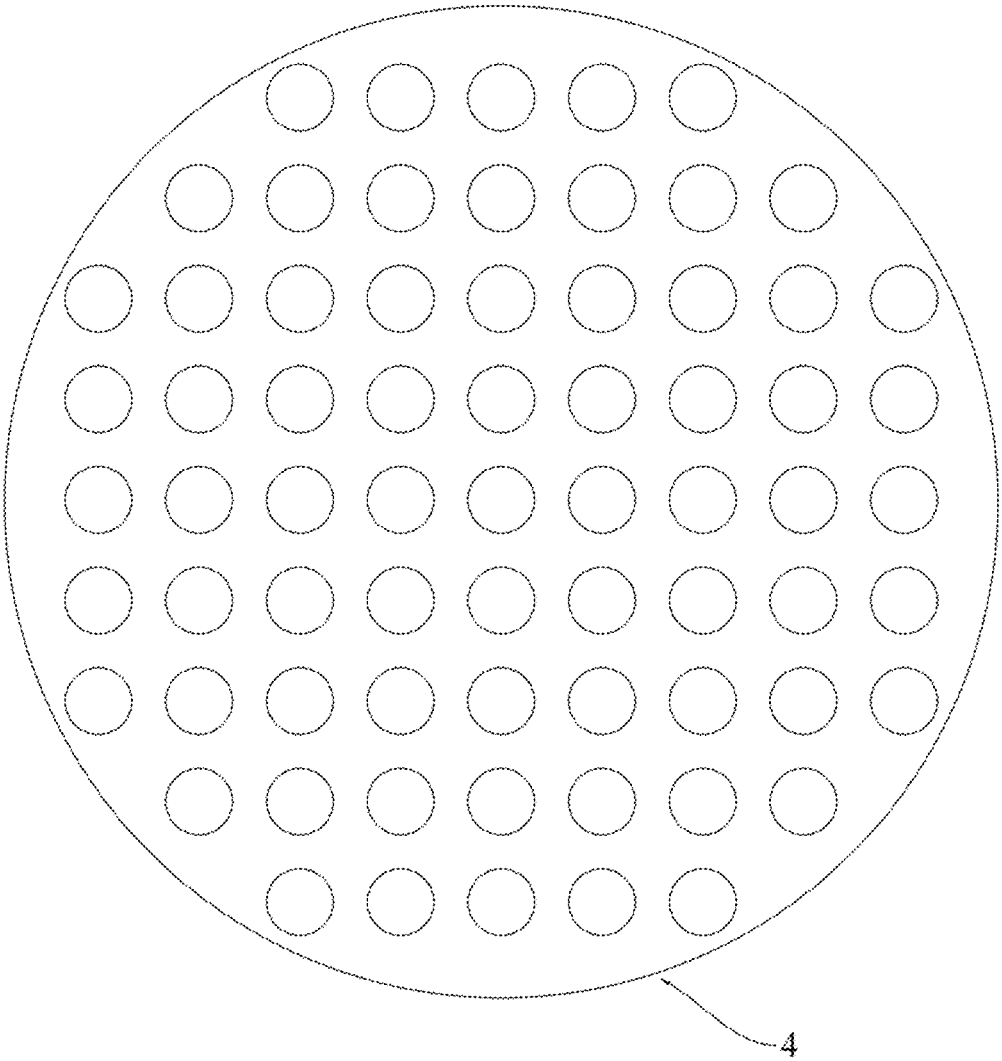
FIG. 7 is a structural schematic diagram of a lighting box according to the present disclosure.

As shown in FIG. 7, the hanging pod further includes lighting box 4. The lighting box 4 is provided between the soft cushion 3 and an inner bottom of the hanging pod body 1. The lighting box 4 is internally provided with a bead, a battery, and a switch. After the lighting box 4 lights up, light penetrates the bottom of the hanging pod body 1, causing the bottom of the hanging pod body 1 to appear in a luminous state.

Figure 6:
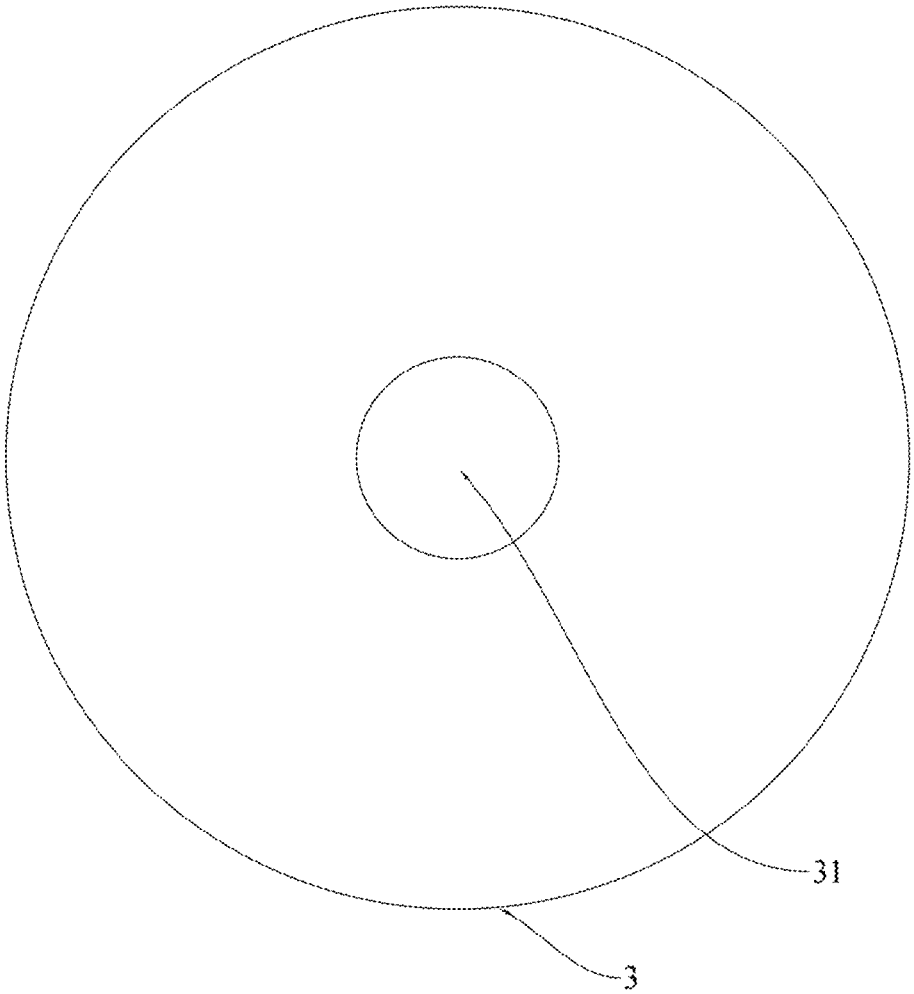
FIG. 6 is a structural schematic diagram of a mounting recess according to the present disclosure.

Preferably, as shown in FIGS. 5 and 6, the soft cushion 3 is a transparent circular sealed structure that is internally inflated. A bottom of the soft cushion 3 is provided with mounting recess 31, and the lighting box 4 is provided inside the mounting recess 31. After the lighting box 4 lights up, the light shines upward through the transparent soft cushion 3 and illuminates the interior of the hanging pod body 1, providing light for the interior of the hanging pod.

Figure 2:
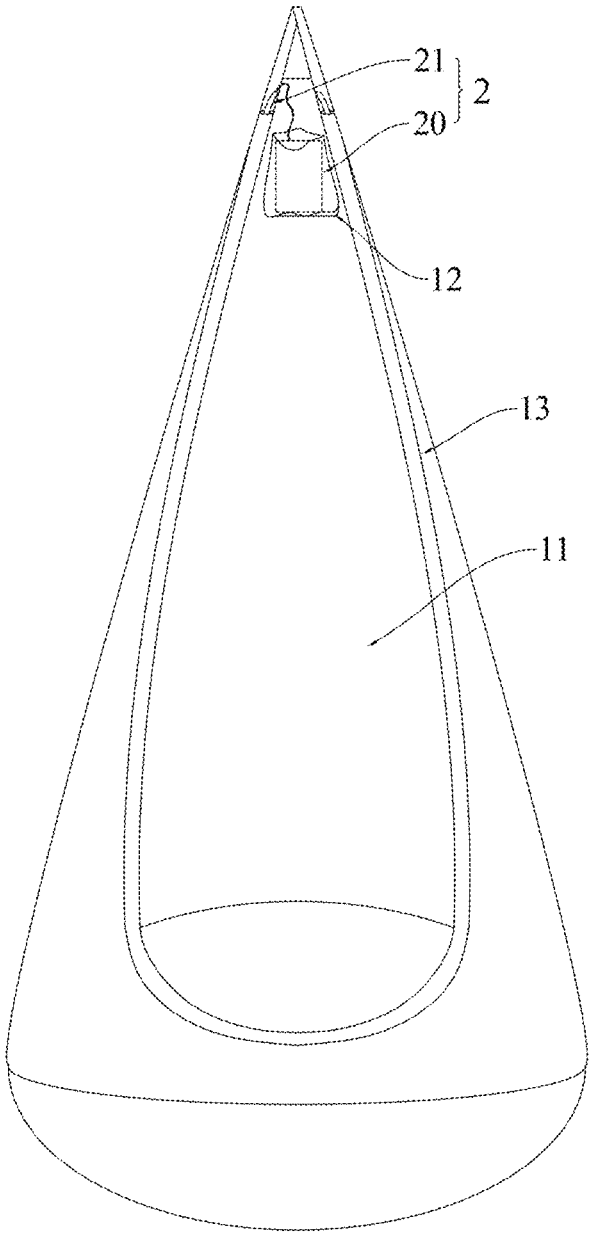
FIG. 2 is a structural schematic diagram of a light-emitting device according to Embodiment 1 of the present disclosure.

Embodiment 1: Referring to FIG. 2, the light-emitting device 2 includes a power supply, a controller, and light strip 21. The light strip 21 and the power supply are connected to the controller through a wire. The controller is an existing circuit structure/integrated chip, and the present disclosure does not make any improvements to the circuit structure/chip of the controller. Preferably, the light strip 21 is a light-emitting diode (LED) light strip 21. The controller is configured to control the light strip 21 by means including but limited to the on/off, color changes, and flashing frequency of the light strip 21. An upper part of an inner surface of the hanging pod body 1 is provided with storage bag 12. The controller and the power supply are provided inside the storage bag 12. Specifically, the power supply is a battery. The battery and the controller are integrated into control box 20, and the controller box is provided in the storage bag. The hanging pod body is provided with storage recess 13 according to a set shape, and the light strip 21 is provided in the storage recess 13. After the light strip 21 lights up, the light penetrates the storage recess 13 to present the set shape. The design improves the aesthetics and fun of the hanging pod while providing lighting.

Preferably, the storage recess 13 is provided along a shape of the first opening 11.

Figure 3:
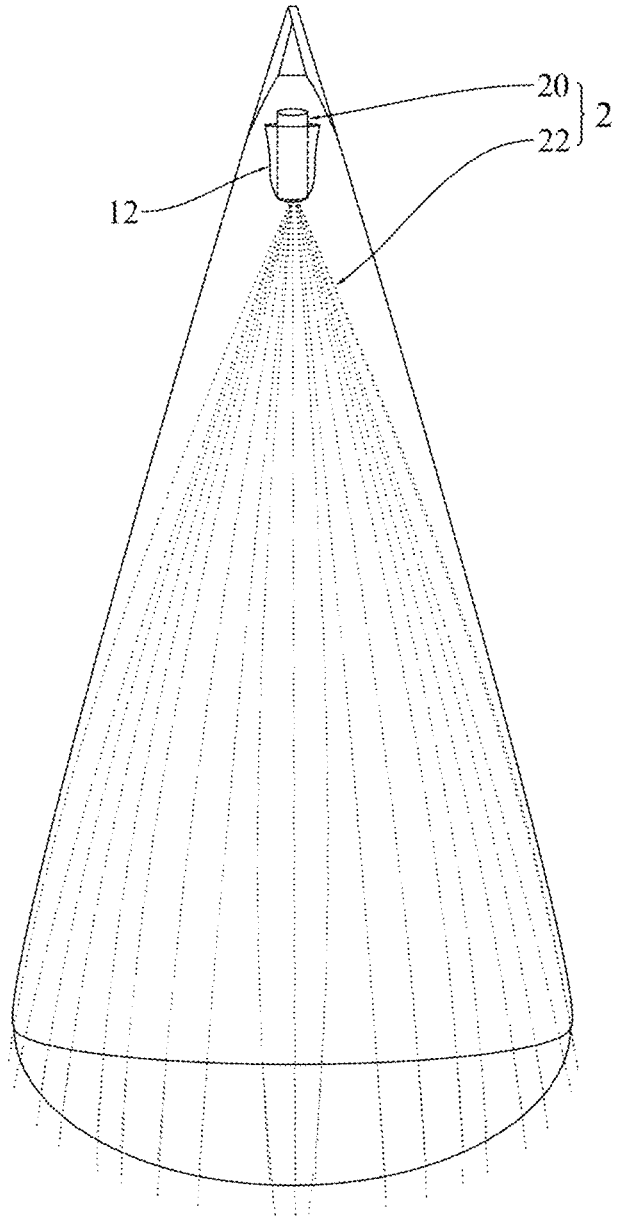
FIG. 3 is a structural schematic diagram of the light-emitting device according to Embodiment 2 of the present disclosure.
Figure 4:
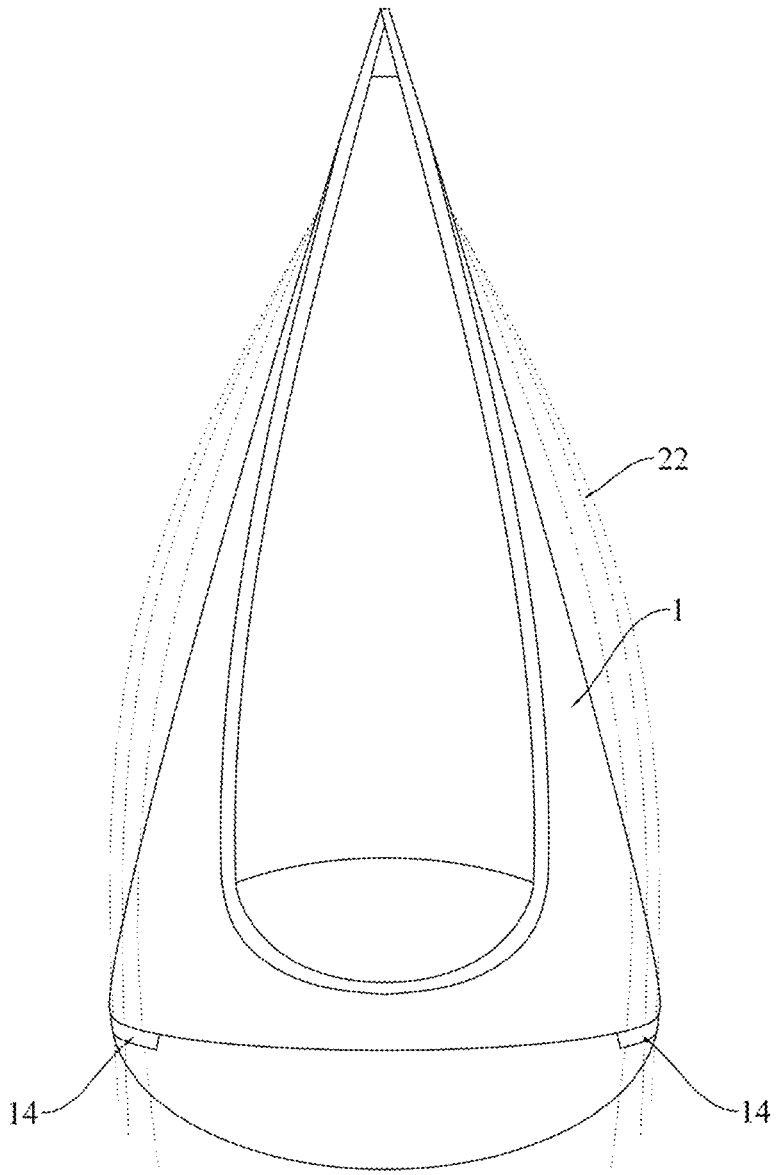
FIG. 4 is a structural schematic diagram of a back of the light-emitting device according to Embodiment 2 of the present disclosure.

Embodiment 2: referring to FIGS. 3 and 4, the light-emitting device 2 includes a power supply, a controller, a light-emitting element, and multiple light-diffusing fibers 22. The light-emitting element and the power supply are connected to the controller through a wire. The controller is an existing circuit structure/integrated chip, and the present disclosure does not make any improvements to the circuit structure/chip of the controller. Preferably, the light-emitting element is an LED bead. One end of each of the multiple light-diffusing fibers 22 is connected to the light-emitting element. The light propagates sequentially along the light-diffusing fiber 22. Inner walls of the light-diffusing fibers 22 are provided with diffuse reflection layers at intervals. After the light-emitting element lights up, the light-diffusing fibers 22 emit light as a whole and display multiple bright spots at intervals. An upper part of an outer surface of the hanging pod body 1 is provided with storage bag 12. The controller, the power supply, and the light-emitting element are provided in the storage bag 12. Specifically, the power supply is a battery. The battery, the controller, and the light-emitting element are integrated into control box 20, and the control box is provided in the storage bag. The multiple light-diffusing fibers 22 extend from the storage bag 12 and are distributed across the outer surface of the hanging pod body 1. The design improves the aesthetics and fun of the hanging pod while providing lighting.

In addition, as shown in FIG. 4, the outer surface of the hanging pod body 1 is provided with limiting member 14. The limiting member 14 is mainly located at left and right sides of the first opening 11, extending along the junction between the side and bottom surface of the hanging pod body 1. Alternatively, the limiting member 14 surrounds the hanging pod body 1 once. Preferably, the limiting member 14 is a strap. The light-diffusing fibers 22 are wrapped from a back of the hanging pod body 1 to the left and right sides of the first opening 11, and are detachably connected to the limiting member 14. The design effectively ensures that the multiple light-diffusing fibers 22 are uniformly distributed across the left and right sides of the first opening 11, improving the uniformity of the light-diffusing fibers 22.

In an implementation, the hanging pod body 1 and the connector 10 are fabric products made of a fabric or rope net. The connector 10 is integrated with the hanging pod body 1 to improve the durability of the hanging pod body 1.

Figure 8:
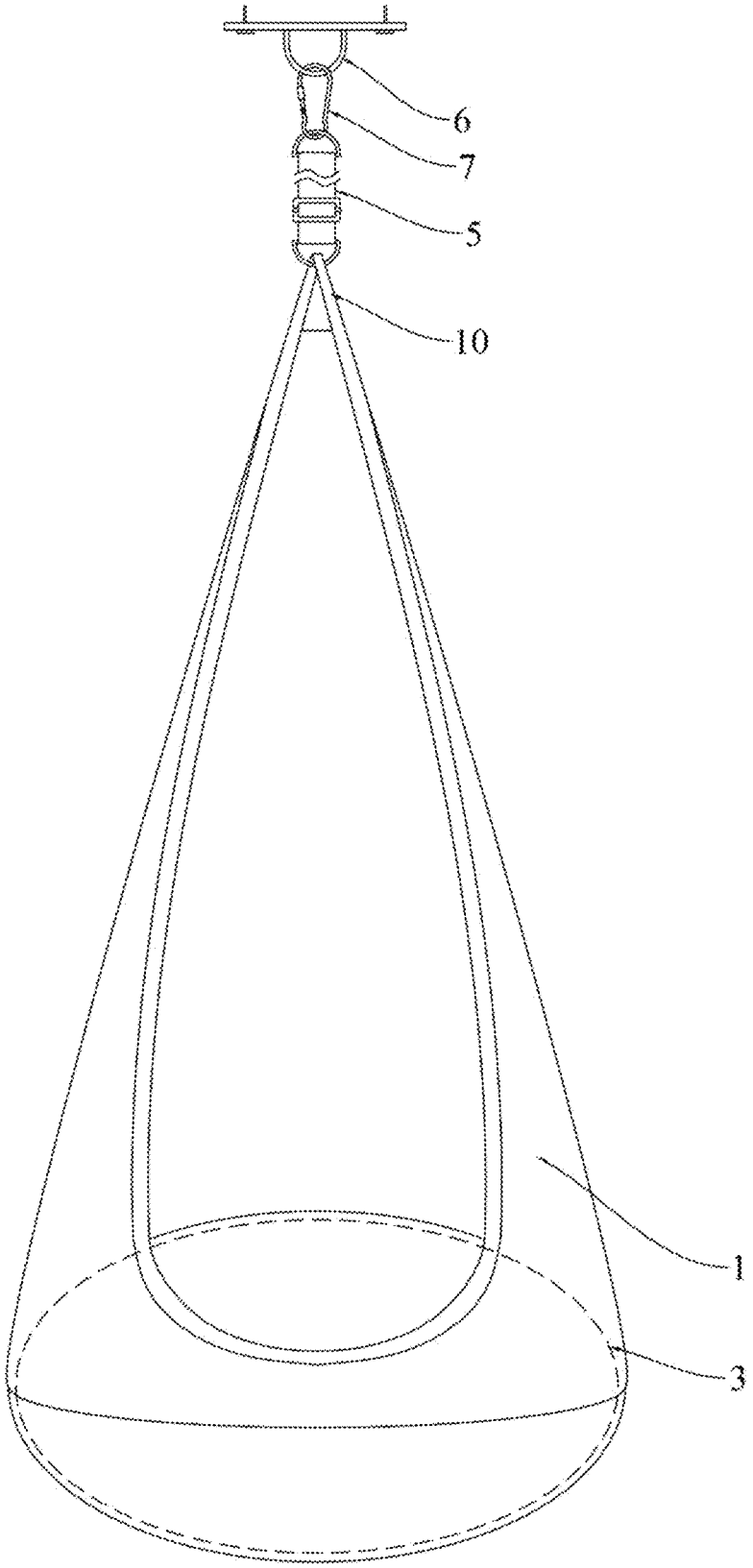
FIG. 8 shows a hanging pod using a first setup method according to the present disclosure.

Furthermore, as shown in FIG. 8, the hanging pod further includes adjustable strap 5. The adjustable strap 5 is detachably connected to the connector 10. By adjusting a distance between the bottom surface of the hanging pod body 1 and a ground through the adjustable strap 5, the hanging pod can adapt to hanging points of different heights.

Figure 9:
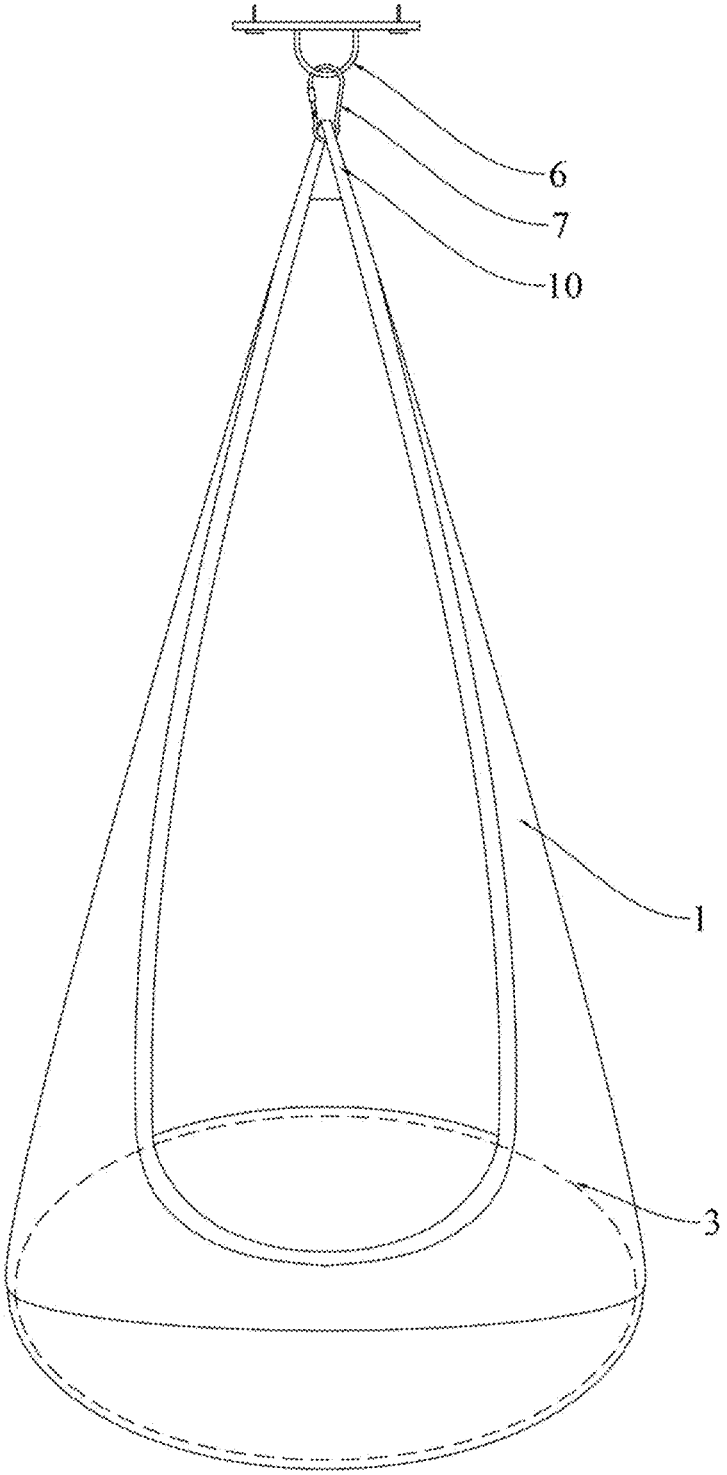
FIG. 9 shows the hanging pod using a second setup method according to the present disclosure.

Furthermore, as shown in FIGS. 8 and 9, in order to facilitate indoor mounting for the user, the hanging pod further includes mounting bracket 6. The mounting bracket 6 includes a mounting plate, a hanging loop, and safety hook 7. The mounting plate is provided with a mounting hole and fixed to a ceiling by a bolt. The hanging loop is welded to the mounting plate. The adjustable strap 5 or the connector 10 is connected to the hanging loop through the safety hook 7. The design features high mounting stability and convenient disassembly and assembly.

It should be understood that in the description of the present disclosure, terms such as "first" and "second" are used merely for a descriptive purpose, and should not be construed as indicating or implying relative importance, or implicitly indicating the number of indicated technical features. Thus, features defined with "first" and "second" may explicitly or implicitly include one or more of the features. In the description of the present disclosure, the term "a plurality of" means two or more, unless otherwise specifically defined.

In the present disclosure, unless otherwise clearly specified, the terms "mounting", "interconnection", "connection" and "fixation" are intended to be understood in a broad sense. For example, the connection may be a fixed connection, removable connection or integral connection; may be a mechanical connection or electrical connection; may be a direct connection or indirect connection using a medium; and may be a communication or interaction between two elements. Those of ordinary skill in the art may understand the specific meanings of the above terms in the present disclosure based on specific situations.

In the present disclosure, unless otherwise explicitly stipulated, "a first feature is above or below a second feature" may indicate that "the first and second features are in direct contact" or "the first and second features are in indirect contact through an intermediate feature". In addition, when it is described that the first feature is "over", "above" and "on" the second feature, it indicates that the first feature is directly or obliquely above the second feature, or simply indicates that the horizontal height of the first feature is greater than that of the second feature. When it is described that a first feature is "under", "below" or "beneath" a second feature, it indicates that the first feature is directly or obliquely under the second feature or simply indicates that the first feature is lower than the second feature.

In the description of this specification, the description with reference to the terms such as "one embodiment", "some embodiments", "embodiments", "an example", "a specific example" and "some examples" indicate that the specific features, structures, materials, or characteristics described with reference to the embodiment or example are included in at least one embodiment or example of the present disclosure. In this specification, the schematic expression of the above terms is not necessarily directed to the same embodiment or example. Furthermore, the specific features, structures, materials, or characteristics described may be combined in a suitable manner in any one or more of embodiments or examples. In addition, those skilled in the art may combine different embodiments or examples described in this specification and characteristics of the different embodiments or examples without mutual contradiction.

Although the embodiments of the present disclosure have been described above, it should be understood that the above embodiments are exemplary, and may not be construed as limitations to the present disclosure. A person of ordinary skill in the art may make various changes, modifications, replacements and variations on the above embodiments within the scope of the present disclosure.

What is claimed is:

1. A hanging pod, comprising:

a hanging pod body, wherein the hanging pod body is hollow and conical; and a top of the hanging pod body is provided with a connector;

a light-emitting device, wherein the light-emitting device is detachably connected to the hanging pod body; and a cushion, wherein the cushion is provided at a bottom of the hanging pod body;

wherein a side of the hanging pod body is provided with a first opening that runs through inner and outer sides of the hanging pod body;

the light-emitting device comprises a power supply, a controller, and a light strip; and the light strip and the power supply are connected to the controller through a wire;

the hanging pod body is provided with a storage bag; and the controller and the power supply are provided inside the storage bag;

the hanging pod body is provided with a storage recess according to a set shape; and the light strip is provided in the storage recess; and the storage recess is provided along a shape of the first opening.

2. The hanging pod according to claim 1, wherein the cushion is provided inside the hanging pod body and located at the bottom of the hanging pod body.

3. The hanging pod according to claim 1, wherein the cushion is a circular sealed structure filled with air inside.

4. The hanging pod according to claim 1, wherein the hanging pod body is a fabric product; and the connector is integrated with the hanging pod body.

5. The hanging pod according to claim 1, wherein the hanging pod further comprises an adjustable strap; and the adjustable strap is detachably connected to the connector.

6. The hanging pod according to claim 5, wherein the hanging pod further comprises a mounting bracket; and the mounting bracket is connected to the adjustable strap or the connector.

7. A hanging pod, comprising:

a hanging pod body, wherein the hanging pod body is hollow and conical; and a top of the hanging pod body is provided with a connector;

a light-emitting device, wherein the light-emitting device is detachably connected to the hanging pod body; and a cushion, wherein the cushion is provided at a bottom of the hanging pod body;

wherein the light-emitting device comprises a power supply, a controller, a light-emitting element, and a plurality of light-diffusing fibers; the light-emitting element and the power supply are connected to the controller through a wire; and one end of each of the plurality of light-diffusing fibers is connected to the light-emitting element; and the hanging pod body is provided with a storage bag; the controller, the power supply, and the light-emitting element are provided in the storage bag; and the plurality of light-diffusing fibers cover an outer surface of the hanging pod body.

8. The hanging pod according to claim 7, wherein the outer surface of the hanging pod body is provided with a limiting member; and some of the plurality of light-diffusing fibers are detachably connected to the limiting member.

9. A hanging pod, comprising:

a hanging pod body, wherein the hanging pod body is hollow and conical; and a top of the hanging pod body is provided with a connector;

a light-emitting device, wherein the light-emitting device is detachably connected to the hanging pod body;

a cushion, wherein the cushion is provided at a bottom of the hanging pod body; and a lighting box, wherein the lighting box is provided between the cushion and the bottom of the hanging pod body.

10. The hanging pod according to claim 9, wherein the cushion is a transparent circular sealed structure; a bottom of the cushion is provided with a mounting recess; and the lighting box is provided inside the mounting recess.

* * * * *